US011845607B1

(12) United States Patent
Christian

(10) Patent No.: US 11,845,607 B1
(45) Date of Patent: Dec. 19, 2023

(54) TWO-PART GARBAGE CAN

(71) Applicant: 3 BOYS ENTERPRISES, LLC, Gallatin, TN (US)

(72) Inventor: Jeffrey S. Christian, Gallatin, TN (US)

(73) Assignee: 3 Boys Enterprises, LLC, Gallatin, TN (US)

( * ) Notice: Subject to any disclaimer, the term of this patent is extended or adjusted under 35 U.S.C. 154(b) by 0 days.

(21) Appl. No.: 18/051,955

(22) Filed: Nov. 2, 2022

(51) Int. Cl.
*B65F 1/06* (2006.01)
*B65F 1/12* (2006.01)

(52) U.S. Cl.
CPC ..... *B65F 1/068* (2013.01); *B65F 1/125* (2013.01); *B65F 2220/101* (2013.01); *B65F 2230/15* (2013.01)

(58) Field of Classification Search
CPC ..... B65F 1/068; B65F 1/125
See application file for complete search history.

(56) References Cited

U.S. PATENT DOCUMENTS

| | | | | |
|---|---|---|---|---|
| 3,997,072 | A | 12/1976 | Guth | |
| 4,643,380 | A | 2/1987 | Copeland | |
| 4,842,228 | A | 6/1989 | Kasper | |
| 6,508,377 | B1 | 1/2003 | Griswold et al. | |
| 6,815,036 | B1 | 11/2004 | Romero | |
| 7,500,430 | B2 | 3/2009 | Claflin et al. | |
| 9,815,622 | B2 | 11/2017 | Dafoe | |
| 10,858,181 | B1 | 12/2020 | Christian | |
| 2002/0003144 | A1 | 1/2002 | Grimes | |
| 2005/0230572 | A1* | 10/2005 | Fisher | B65F 1/1415 248/97 |
| 2008/0023480 | A1* | 1/2008 | Fisher | B65F 1/06 220/495.06 |
| 2010/0282765 | A1 | 11/2010 | Hayes | |
| 2013/0048641 | A1 | 2/2013 | Romano | |

FOREIGN PATENT DOCUMENTS

| | | | |
|---|---|---|---|
| EP | 1580148 | A1 | 9/2005 |
| JP | 2003267505 | A | 9/2003 |
| KR | 100966235 | B1 | 6/2010 |
| KR | 200490961 | Y1 | 1/2020 |

OTHER PUBLICATIONS

International Search Report issued in International Patent Application No. PCT/US2021/036395 dated Sep. 10, 2021.
Written Opinion issued in International Patent Application No. PCT/US2021/036395 dated Sep. 10, 2021.

* cited by examiner

*Primary Examiner* — Stephen J Castellano
(74) *Attorney, Agent, or Firm* — United IP Counselors, LLC

(57) ABSTRACT

A trash can with a separable base and sidewall. The base and the sidewall have cooperating engaging structures, such as slots in the sidewall and tabs on an inner face of a perimeter wall of the base. The base has a projecting ledge on an outer face of the perimeter wall. The sidewall and base are separated from one another by depressing the projecting ledge, thereby causing the base to resiliently deform and move at least one of the cooperating engaging structures of the base out of engagement with its counterpart on or in the sidewall.

9 Claims, 4 Drawing Sheets

TWO-PART GARBAGE CAN

TECHNICAL FIELD

The invention relates to trash cans.

BACKGROUND

The humble trash can is ubiquitous in modern homes. Meant to store trash temporarily until it can be removed to a larger container for collection, trash cans are used in a variety of sizes throughout the home. While trash cans are made in nearly endless varieties, the typical trash can is essentially a round or rectilinear bucket. A lid may or may not be used to cover the trash can. In many cases, a plastic trash bag, or other type of impermeable liner, is used with the trash can. The trash bag helps to contain liquids and odors and keeps the inside of the trash can at least somewhat cleaner.

The problem with the typical trash can and trash bag is well known: emptying the trash can is often an ordeal. Once the trash bag is full, the user is usually required to lift the bag out of the trash can and carry the bag to another container or location for collection. This is often harder than it sounds—a heavily-loaded trash bag may tear or break during the process, potentially allowing trash to fall out. Even if the trash bag does not tear, removing it from the trash may be more difficult than expected: as trash is placed in the bag and air is forced out of the bottom of the trash can, a partial vacuum can be created between the bag and the trash can, increasing the amount of force it takes to drag the trash bag out of the trash can.

U.S. Pat. No. 10,858,181, the work of the present assignee, discloses a type of trash can with a separable base and sidewall. Straps are attached between the base and the sidewall, securing the base and sidewall together. When it comes time to empty the trash can, the straps are removed from the sidewall, and the sidewall is lifted off the base while the trash bag remains on the base. The base can then be carried by the straps to move the trash bag to a larger receptacle.

Over many decades, the patent literature has offered various types of trash cans with separable sidewalls and bottoms. For example, in U.S. Pat. No. 9,815,622 to Dafoe shows a sidewall that is twisted on and off its base. U.S. Pat. No. 6,508,377 to Griswold et al. uses latches to hold the sidewall to the base. U.S. Pat. No. 3,997,072 to Guth, issued in 1976, discloses a compactor container that uses a type of latch to connect sidewall to bottom. However, despite the number of inventions in this area, this type of trash can is not frequently seen in stores.

The reasons why some inventions succeed while others do not are myriad, and some of those reasons have nothing to do with technical merit. Yet with trash cans, some generalization is possible: trash cans are among the simplest household products in use. Many are little more than a large bucket. While trash can designs have been modernized somewhat over the years, and some have even been mechanized, their basic structure has changed little over time. Although each of the patents noted above offers the potentially useful feature of a separable sidewall and base, each seems to introduce some complexity or additional work for the user: straps must be connected and disconnected, latches must be latched or unlatched, etc. These prior designs fail to balance the desire for potentially useful features with the simplicity expected of a trash can.

BRIEF SUMMARY

One aspect of the invention relates to a trash can. The trash can has a sidewall and a base. The sidewall is enclosed and has an upper end and a lower end, both of which are open. A first set of cooperating engaging structures is provided on or in a lower portion of the sidewall. The base is separable from the sidewall but is adapted to accommodate the sidewall so as to close the lower end of the sidewall. The base has a raised perimeter wall. A second set of cooperating engaging structures is provided on or in the raised perimeter wall and is engageable with the first set of cooperating engaging structures. A projecting ledge extends from an outer face of the perimeter wall. The base is constructed of a deformable, resilient material such that pressure on the projecting ledge deforms the base such that at least one of the second set of cooperating engaging structures moves out of engagement with its counterpart so as to allow the sidewall to be removed from the base.

Another aspect of the invention relates to a method for separating the base of a trash can from a sidewall of the trash can. The method comprises depressing a projecting ledge that extends from a perimeter wall of the base of the trash can, thereby causing the base to deform so as to move a first engaging structure in or on the base out of engagement with a second engaging structure on or in the sidewall. The sidewall is then removed from the base, and when the projecting ledge is released, the base resiliently returns to its original shape.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
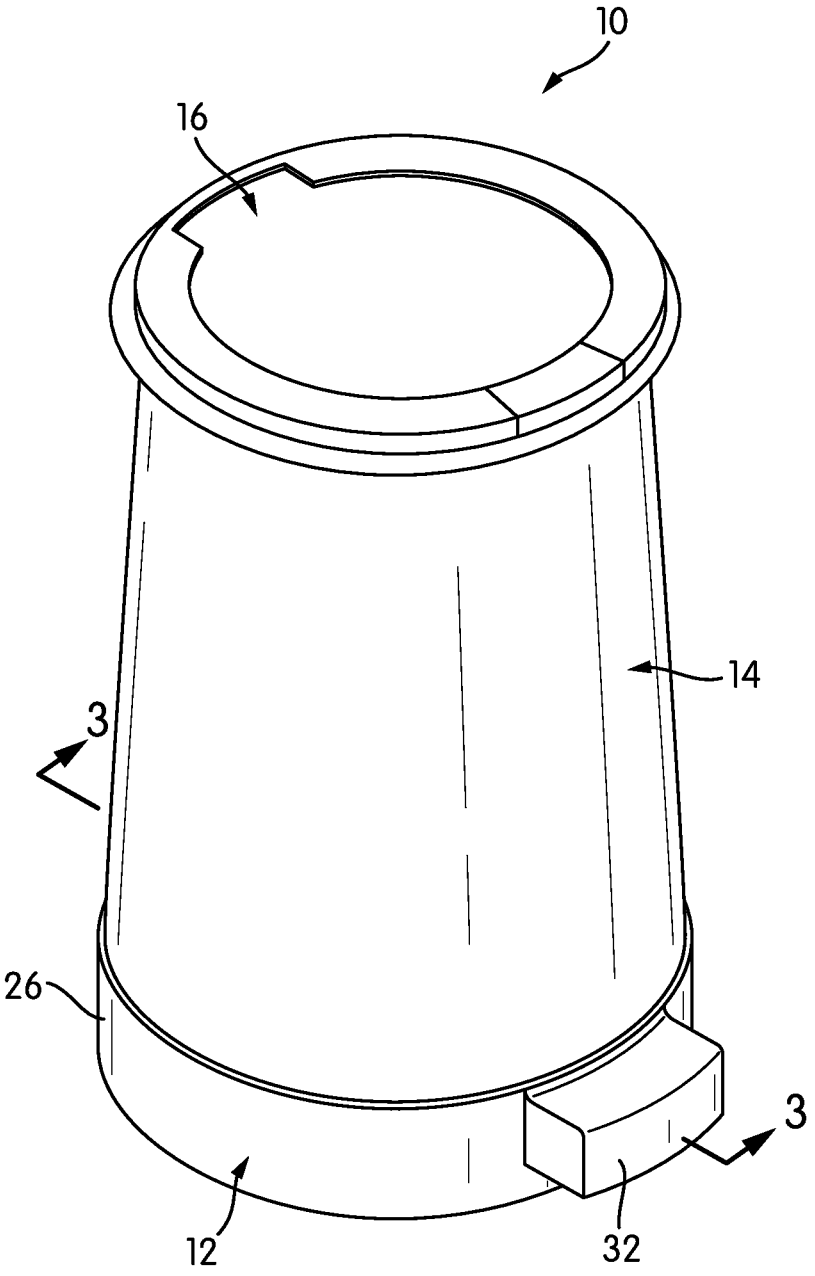
FIG. 1 is a perspective view of a trash can according to one embodiment of the invention.

FIG. 1 is a perspective view of a trash can, generally indicated at 10, according to one embodiment of the invention. The trash can 10 has a base 12, a sidewall 14, and a simple lid 16. As will be described below in more detail, the sidewall 14 is separable from the base 12 in order to facilitate removal of a trash bag from the trash can 10 without having to lift the bag itself out of the trash can 10.

The trash can 10 of FIG. 1 is generally cylindrical in overall shape, although it is not a cylinder: the sidewall 14 increases in diameter from the lid 16 toward the base 12, making the sidewall 14 wider at the bottom than it is at the top. Other shapes, like rectangular and trapezoidal prisms, are possible in other embodiments. While some trash cans according to embodiments of the invention may not be broader at the base 12, that feature may be advantageous.

Figure 2:
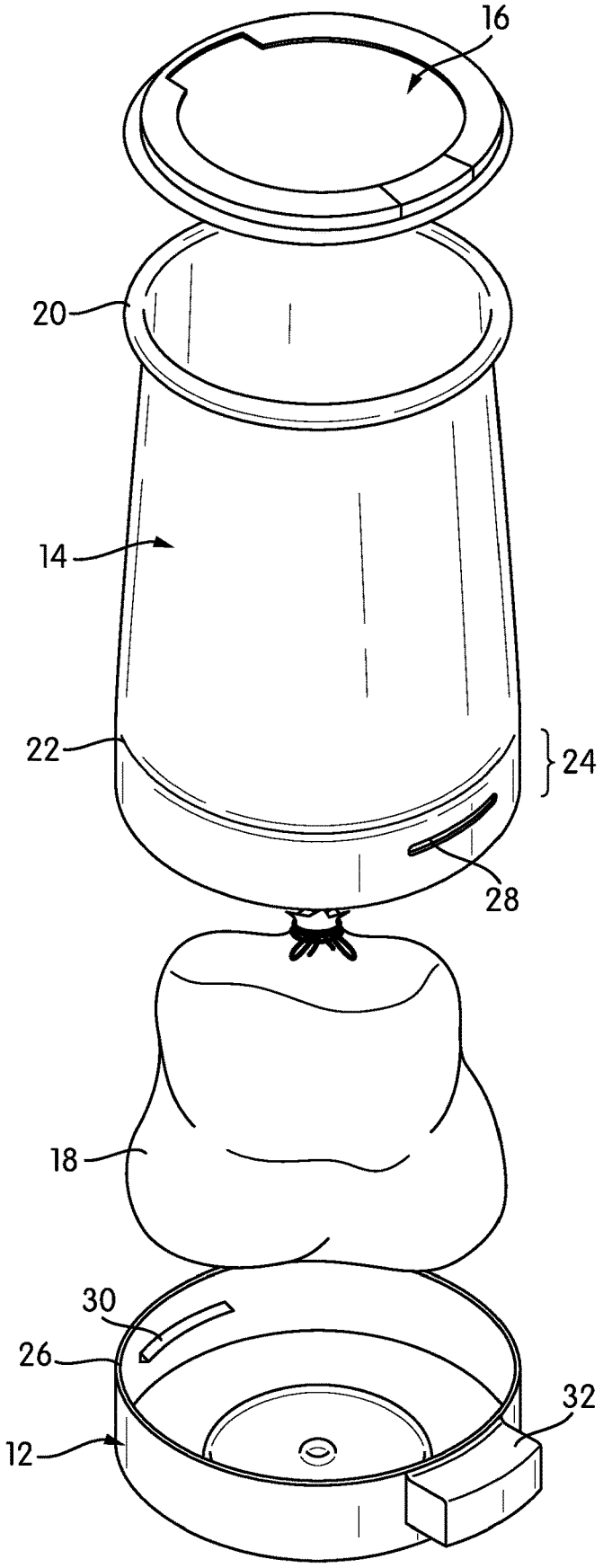
FIG. 2 is an exploded perspective view of the trash can of FIG. 1, illustrating the trash can with a trash bag.
Figure 3:
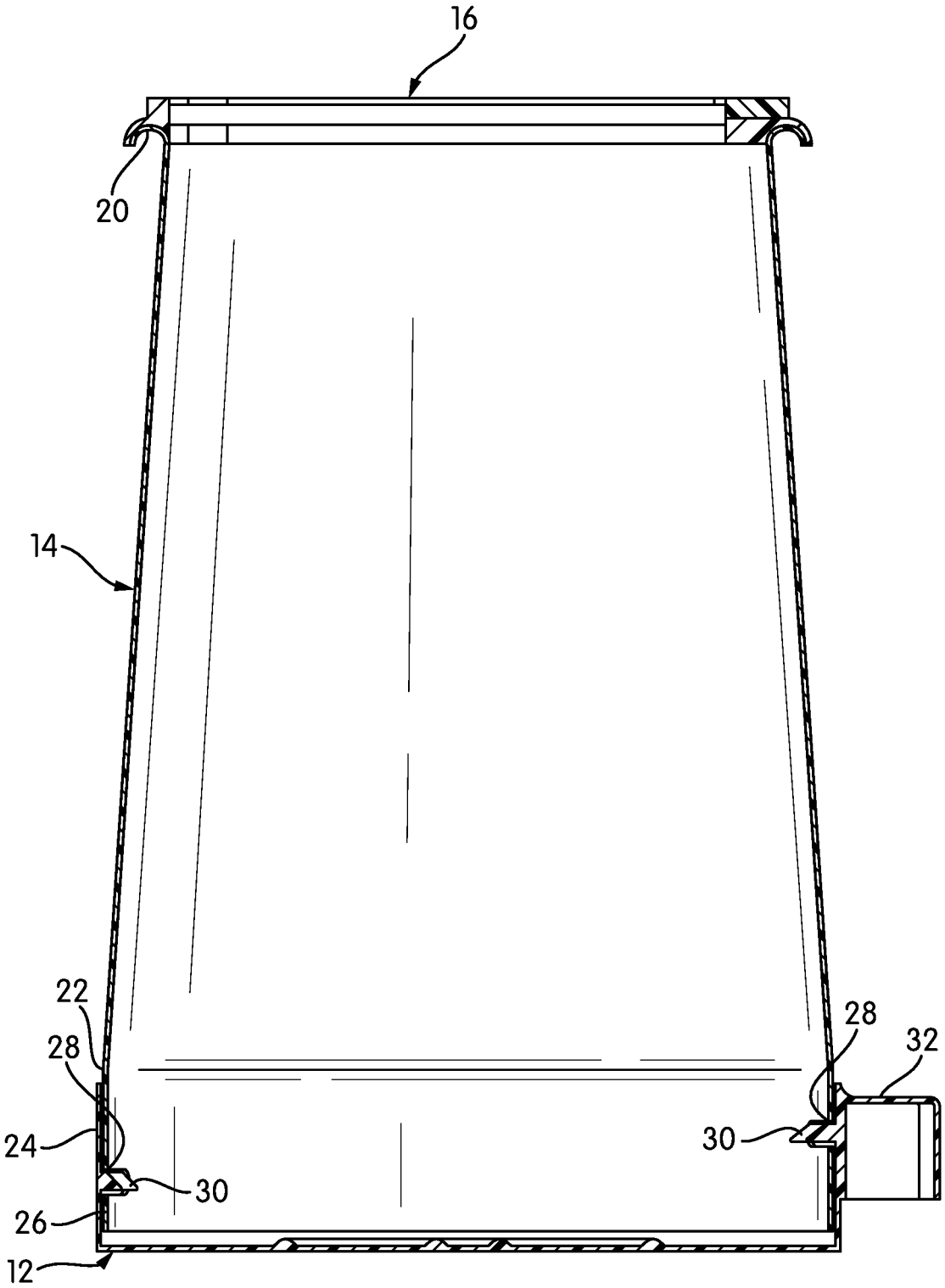
FIG. 3 is a cross-sectional view of the trash can of FIG. 1, taken through Line 3-3 of FIG. 1.

FIG. 2 is an exploded view of the trash can 10 with a garbage bag 18, and FIG. 3 is a cross-sectional view taken through Line 3-3 of FIG. 1. As can be seen in these figures, the upper sidewall 14 has a curved lip 20 that extends outwardly and provides a bearing-resting surface for the lid 16. In some cases, the lid 16 may be hingedly connected to the sidewall 14, but the two 14, 16 are separate pieces in the illustrated embodiment.

The sidewall 14 is open at the top and bottom and forms a closed circumferential wall for the trash can 10. As was described briefly above, the diameter of the sidewall 14 increases from its top toward its bottom. However, in this embodiment, as can be seen in FIGS. 2 and 3, the sidewall 14 does not increase constantly from top to bottom. Rather, there is a plane, indicated at 22 in FIGS. 2 and 3 beyond which the sidewall 14 straightens to extend vertically. Thus, the plane 22 represents the maximum diameter of the sidewall 14, and the diameter of the sidewall 14 remains constant below it. The straight section 24 of the sidewall 14 facilitates engagement with the base 12.

In this embodiment, the base 12 is round with an upward, vertically-extending perimeter wall 26, giving the base 12 the overall shape of a short, open cylinder. The outer diameter of the straight section 24 of the sidewall 14 is just smaller than the inner diameter of the base 12. Thus, the sidewall 14 rests within the base 12 when the trash can 10 is assembled.

The base 12 and the sidewall 14 include complementary engaging structures to connect with one another. Specifically, the sidewall 14 includes two slots 28, spaced equidistantly from one another along the straight section 24 of the sidewall 14. The base 12 includes inwardly-projecting tabs 30 in corresponding positions along the inside of its perimeter wall 24. As can be seen in FIG. 3, in this embodiment, the sidewall 14 rests entirely on the tabs 30, rather than extending down farther to contact the base 12, but the sidewall 14 may do so and rest on the interior bottom of the base 12 in other embodiments. In other embodiments, there may be more or fewer sets of engaging structures 28, 30, and the engaging structures may be of different types than those shown in this embodiment.

As may also be apparent in the views of FIGS. 2 and 3, the sidewall 14 is straight-sided and the engagement between the base 12 and the sidewall 14 is such that there is no constriction or reduction in width in the sidewall 14 in order to connect with the base. Such constrictions, found, for example, in the trash cans of U.S. Pat. No. 9,815,622 to Dafoe, have the potential to interfere with the trash bag 18.

When connected, the base 12 and sidewall 14 serve as a fairly typical trash can. They may be sized to accommodate any common size or style of trash bag 18. The perimeter wall 26 of the base 12 may help to prevent spills or leaks if the trash bag 18 is accidentally breached in the can, or if some trash is not placed properly within the trash bag 18.

When it comes time to remove a trash bag 18 from the trash can 10, the sidewall 14 is disengaged from the base 12. The base 12 includes features to facilitate easy engagement and disengagement with the sidewall 14. Specifically, the base 12 includes a projecting ledge 32 that, in this case, is opposite one of the tabs 30 along the exterior of the perimeter wall 26 of the base 12.

Figure 4:
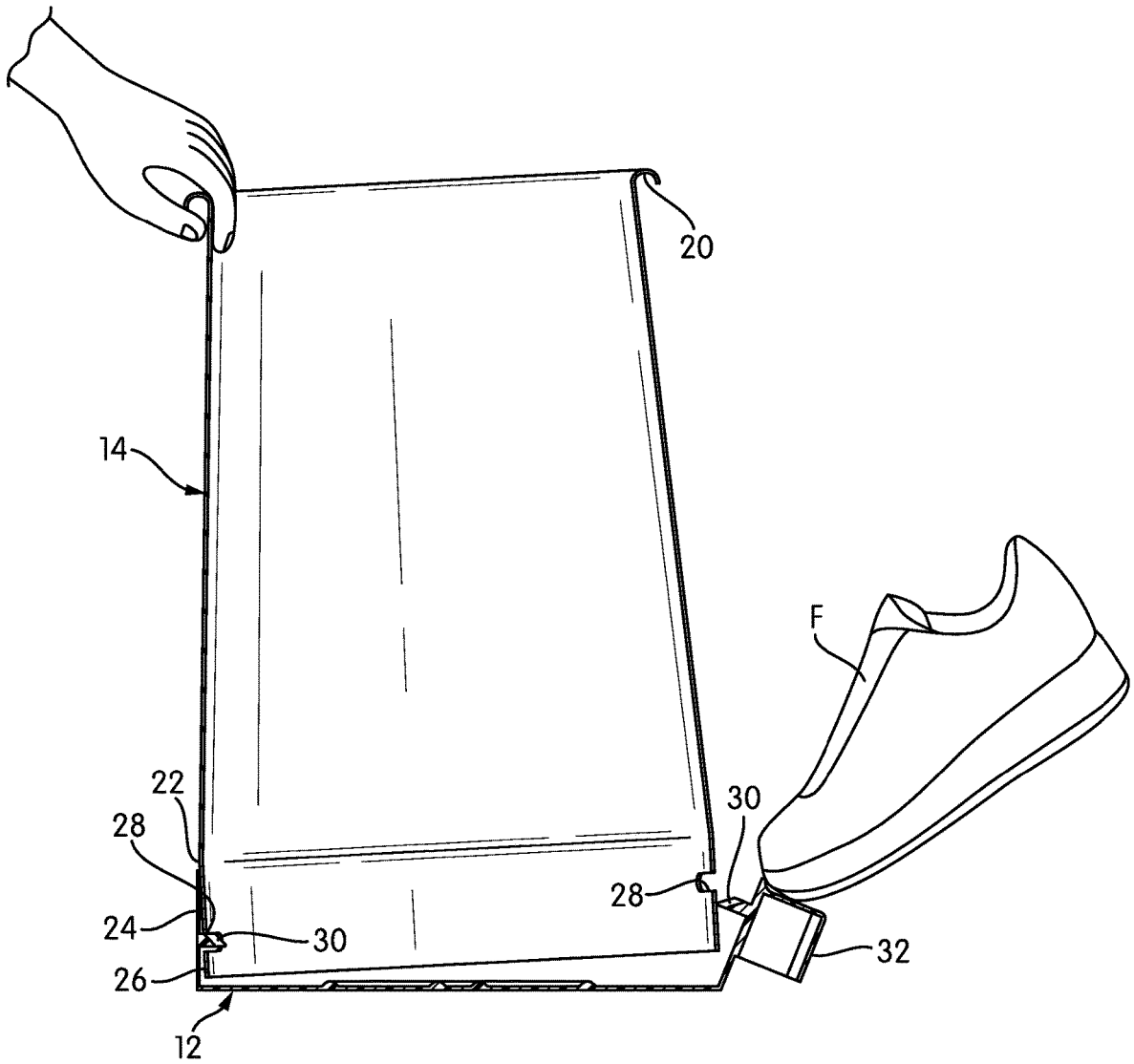
FIG. 4 is a sectional view of the trash can of FIG. 1, illustrating the process of separating the sidewall from the base.

The process of disengaging the base 12 and sidewall 14 is illustrated in FIG. 4, a partially sectional elevational view. In a typical process, a user places a foot F on the projecting ledge 32 of the base 12 and pushes down. The force deforms the base 12 and pulls one of the tabs 30 out of its slot 28 in the sidewall 14. From this position, a user can easily use the lip 20 on the upper part of the sidewall 14 to disengage the other tab 30 from the other slot 28 and lift the sidewall 14 away from the base 12. Reassembly follows an opposite process.

Notably, the disengagement and reassembly processes for the base 12 and sidewall 14 rely on the deformation of the base 12 and its ability to resiliently return to its original shape, rather than a specialized disengagement mechanism. Thus, the material of which the base 12 is made is preferably a material that can withstand such deformation and resiliently return to its original shape. This may be a plastic, a rubber, or another such material capable of undergoing elastic deformation under the amount of force that would typically be applied by the foot F. High-density polyethylene (HDPE) is one suitable material. The base 12 may be injection molded, cast, machined from a block of material, additively manufactured, or made in whichever way is appropriate considering the material.

Additionally, the disengagement process for the base 12 and sidewall 14 are likely to be familiar to the user, and do not require stooping over to loosen or unlatch anything. Pedals are often used in trash cans to open a hinged lid, and the motion of the foot F against the projecting ledge 32 to disengage the base 12 and sidewall 14 is a similar motion.

As was noted briefly above, in this embodiment, the projecting ledge 32 is positioned directly opposite one of the tabs 28 across the thickness of the perimeter wall 26. This positioning need not be replicated in all embodiments, so long as the projecting ledge 32 is positioned such that, when typical foot pressure is applied to it, it can induce enough deformation around a nearby tab 28 to move it enough to allow the sidewall 14 to be freed from the base 12.

The sidewall 14 may be made of the same material as the base 12, or it may be made of a different material. For example, the sidewall 14 may be made of metal, plastic, wood, or a composite. Depending on the material and other considerations, the sidewall 14 may be injection molded, machined from a block of material, cast, made with sheet metal, or additively manufactured.

Depending on the size of the trash can 10 and its intended load-carrying capacity, the base 12 and sidewall 14 may be reinforced appropriately by stiffening ribs and other such structures. Any features formed in the base 12 or sidewall 14 are preferably of a shape that will not snag or tear a trash bag 18.

In the illustrated embodiment, the base 12 and sidewall 14 are shown as having the same, or almost the same, wall thickness. However, that need not be the case in all embodiments. In some embodiments, the base 12 could be thickened, e.g., for additional resilience. The sidewall 14 may have whatever wall thickness is necessary or desirable, so long as it fits within the base 12, although in some cases, the tabs 30 may need to be lengthened if the sidewall 14 is particularly thick. If need be, the base 12 could be weighted for greater stability.

While the invention has been described with respect to certain embodiments, the description is intended to be exemplary, rather than limiting. Modifications and changes may be made within the scope of the invention, which is defined by the appended claims.

What is claimed is:

1. A trash can, comprising:

a enclosed sidewall having an upper end and a lower end spaced from the upper end, both the upper end and the lower end being open, and a first set of cooperating engaging structures integrally formed on or in a lower portion of the sidewall;

a base, separable from the sidewall and adapted to accommodate the sidewall so as to close the lower end of the sidewall, the base having a raised perimeter wall with a second set of cooperating engaging structures, engageable with the first set of cooperating engaging structures of the sidewall, integrally formed on or in an inner face of the perimeter wall, such that either the first set of cooperating engaging structures or the second set of cooperating engaging structures extends inwardly with relative to the sidewall, and a projecting ledge extending from an outer face of the perimeter wall;

wherein the base is constructed of a deformable, resilient material such that pressure on the projecting ledge resiliently deforms the base and to move at least one of the second set of cooperating engaging structures out of engagement with a counterpart of the first set of cooperating engaging structures so as to allow the sidewall to be removed from the base; and wherein the sidewall increases in dimensions from the upper end toward a bottom portion with constant dimensions that terminates at the lower end, the sidewall turning vertical to form the bottom portion with the constant dimensions, the bottom portion having a height that is about equal to a height of the raised perimeter wall of the base, the arrangement being such that the bottom portion of the sidewall is parallel to the raised perimeter wall of the base when the base and the sidewall are engaged with one another.

2. The trash can of claim 1, wherein the projecting ledge is opposite one of the second set of cooperating engaging structures through a thickness of the perimeter wall.

3. The trash can of claim 1, wherein the first set of cooperating engaging structures comprises slots.

4. The trash can of claim 3, wherein the second set of cooperating engaging structures comprises tabs.

5. The trash can of claim 1, further comprising a lip on the upper end of the sidewall.

6. The trash can of claim 5, further comprising a lid adapted to rest on the lip.

7. The trash can of claim 1, wherein the sidewall and the base each have round cross-sections, such that the sidewall increases in diameter from the upper end toward the bottom portion, and the bottom portion has a constant diameter.

8. The trash can of claim 7, wherein the sidewall increases in diameter from the upper end to the bottom portion.

9. The trash can of claim 8, wherein an upper end of the bottom portion of the sidewall constitutes a plane of maximum dimension of the sidewall.

* * * * *